US006988455B2

(12) United States Patent
Lee et al.

(10) Patent No.: US 6,988,455 B2
(45) Date of Patent: Jan. 24, 2006

(54) SEWING MACHINE

(75) Inventors: Jae-Hak Lee, Inchon (KR); Kyong-Min Ryu, Seoul (KR)

(73) Assignee: Sunstar Machinery Co., Ltd., (KR)

( * ) Notice: Subject to any disclaimer, the term of this patent is extended or adjusted under 35 U.S.C. 154(b) by 0 days.

(21) Appl. No.: 10/813,983

(22) Filed: Mar. 31, 2004

(65) Prior Publication Data

US 2005/0000397 A1 Jan. 6, 2005

(30) Foreign Application Priority Data

Jul. 2, 2003 (KR) ..... 20-2003-0021154
Feb. 6, 2004 (KR) ..... 10-2004-0007981

(51) Int. Cl.
*D05B 21/00* (2006.01)

(52) U.S. Cl. ..... 112/470.12

(58) Field of Classification Search ..... 112/259, 112/470.12, 470.13, 103, 260, 217.1, 217.3, 112/117, 118, 119, 470.14
See application file for complete search history.

(56) References Cited

U.S. PATENT DOCUMENTS 3,180,293 A * 4/1965 Cash ..... 112/118
3,354,850 A * 11/1967 Story ..... 112/118
4,691,651 A * 9/1987 Junemann ..... 112/259
4,953,485 A * 9/1990 Brower et al. ..... 112/475.05
5,642,679 A * 7/1997 Monget et al. ..... 112/470.13
5,809,918 A * 9/1998 Tajima et al. ..... 112/103
5,887,536 A * 3/1999 Hayashi ..... 112/470.18

* cited by examiner

*Primary Examiner*—Ismael Izaguirre
(74) *Attorney, Agent, or Firm*—Galgano & Burke, LLP

(57) ABSTRACT

A sewing machine comprises: a head portion having a sewing needle driven to vertically reciprocate; a lower shaft having a shuttle connected thereto which is driven to rotate synchronized with the vertical movement of the sewing needle cooperating to form stitches; a table positioned above the lower shaft; a retainer positioned above the table to retain a material for forming stitches thereon; a holding frame placed parallel to the table, the head portion being mounted at a position on the holding frame; and supporting posts adapted to support opposite ends of the holding frame for positioning the holding frame above the table. The sewing machine allows a material to be sewn, which is retained retainer, to be easily mounted or removed.

13 Claims, 9 Drawing Sheets

SEWING MACHINE

BACKGROUND OF THE INVENTION

1. Field of the Invention

The present invention relates to a sewing machine with improved structure and constitution, and more particularly to a sewing machine in which a retainer adapted to retain a material to be sewn can move along an X-axis and a Y-axis.

2. Description of the Prior Art

When it is necessary to extend the sewing range of conventional sewing machines, in particular in the Y-axis direction (forward or backward direction), the arm on which the head portion of the sewing machine is installed had to be elongated forward. This causes a problem in that the elongated arm occupies a considerable space.

Moreover, when the arm is elongated, the center of gravity of the sewing machine is positioned at a front portion thereof This makes it difficult to maintain the balance of the sewing machine. Accordingly, there has been a request for a construction capable of reducing the space occupied by the sewing machine while easily maintaining the balance of the sewing machine.

An example of such conventional sewing machines is given in FIG. 1. FIG. 1 shows a side elevation view of a conventional sewing machine disclosed in Korean Patent Application No. 1999-0015717, the content of which is incorporated herein for reference (reference numerals presented hereinafter to explain FIG. 1 apply to FIG. 1 only). Referring to FIG. 1, the conventional sewing machine has a head portion 202 elongated toward the front side of its body 203 by means of an arm 201. The longer the material to be sewn is in the Y-axis direction (forward or backward direction) as retained on a retainer 204 atop a table 200, the longer the arm 201 needs to be.

As the arm 201 becomes longer, the head portion 202 becomes farther from the body 203. This makes the center of gravity of the sewing machine positioned at the front portion thereof Consequently, the body 203, having the arm 201 connected thereto, is subject to additional weight and torsion due to the lengthened arm 201. It results in a problem in strength of the machine. Therefore, there has existed a demand for a sewing machine making it possible to minimize or eliminate the length of an aim 201 for the purpose of avoiding any damage to its body 203 and, at the same time, to extend the sewing area in the X-axis direction (leftward or rightward direction) and/or Y-axis direction of the sewing machine.

Meanwhile, conventional sewing machines employ single driving motor to drive both a needle and a shuttle race body, as shown in FIG. 2. Referring to FIG. 2, a single driving motor 230 is adapted to drive an upper shaft 210 for driving a needle 205, as well as a lower shaft 220 for driving a shuttle race body (not shown in the drawing).

The driving motor 230 is connected in a line with the upper shaft 210. The lower shaft 220 is positioned below a table 200 and is parallel to the upper shaft 210. A rotation transfer means 240, such as a timing belt, is used to enable the single driving motor 230 to drive both the upper and lower shafts 210 and 220.

Such a simultaneous driving of the upper and lower shafts 210 and 220 necessitates the interconnection and coupling of them within the arm 201 and the body 203. When the arm 201 and the body 203 need to be removed to extend the sewing area in the Y-axis direction, as mentioned above, the simultaneous driving of the upper and lower shafts 210 and 220 cannot be implemented. Therefore, it is necessary to solve such problem and, at the same time, to provide an improved construction accordingly.

SUMMARY OF THE INVENTION

Accordingly, the present invention has been made to solve the above-mentioned problems occurring in the prior art, and an object of the present invention is to provide a sewing machine having a feeding device which can move a retainer, on which a material to be sewn is retained, in the X-axis or Y-axis direction so that sewing can be performed in an extended sewing area regardless of the position of its head portion.

Another object of the present invention is to provide a sewing machine having an arm lifting device which can move its head portion in the upward or downward direction so that a material to be sewn, which is retained on a retainer, can be easily mounted or removed.

Still another object of the present invention is to provide a sewing machine having an upper shaft driving motor and a lower shaft driving motor for driving its upper and lower shafts, respectively, as a result of having removed its arm and body so that the upper and lower shafts can be driven in accordance with its improved constitution.

In order to accomplish this object, there is provided a sewing machine comprising: a head portion for mounting a needle for sewing thereon; a table for accommodating a material to be sewn thereon; a holding frame for mounting the head portion thereon; and supporting posts for supporting and positioning the holding frame above the table.

According to a feature of the present invention, the holding frame is positioned horizontally in the X-axis direction and the supporting posts are adapted to support the opposite ends of the holding frame vertically.

According to another feature of the present invention, the sewing machine further comprises a retainer for retaining a material to be sewn and an X-axis feeding means for moving the retainer leftward or rightward in the X-axis direction.

According to another feature of the present invention, the X-axis feeding means comprises: an X-axis flame elongated in the leftward and rightward direction; a guide rail installed or formed in the X-axis flame; a holding portion coupled with the guide rail and adapted to move in the leftward or rightward direction while holding the retainer, and an X-axis driving motor for moving the holding portion.

According to another feature of the present invention, the sewing machine further comprises a retainer for retaining a material to be sewn and a Y-axis feeding means for moving the retainer forward or backward in the Y-axis direction.

According to another feature of the present invention, the Y-axis feeding means comprises: a moving portion for moving the retainer in the forward or backward direction; and a Y-axis driving motor for moving the moving portion.

According to another feature of the present invention, the sewing machine further comprises a Y-axis feeding means for moving the X-axis feeding means forward or backward in the Y-axis direction.

According to another feature of the present invention, the Y-axis feeding means comprises: a moving portion for moving the X-axis feeding means in the forward or backward direction; and a Y-axis driving motor for moving the moving portion.

According to another feature of the present invention, the moving portion comprises a belt moved by the Y-axis driving motor.

According to another feature of the present invention, the sewing machine further comprises an arm lifting device coupled to the holding frame together with the head portion for moving the head portion upward or downward.

According to another feature of the present invention, the arm lifting device comprises: a guide plate held on the holding frame; and a feeder held on the head portion, wherein the feeder is adapted to move upward or downward in accordance with the guide plate.

According to another feature of the present invention, the arm lifting device is moved upward or downward by hydraulic pressure, pneumatic pressure, or a mechanical structure utilizing the rotation of a screw structure.

According to another feature of the present invention, the sewing machine further comprises: an upper shaft driving motor connected to an upper shaft for driving the sewing needle of the head portion; and a lower shaft driving motor connected to the lower shaft for driving a shuttle race body.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
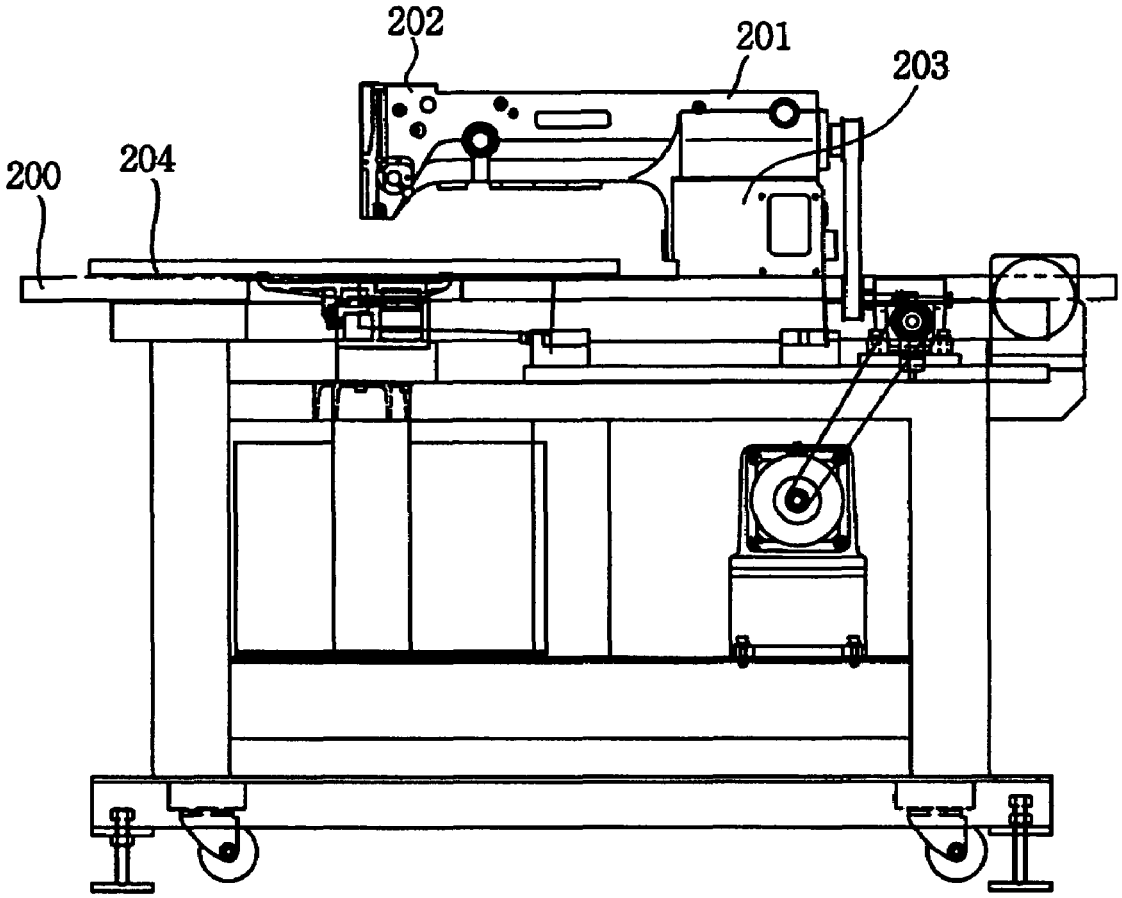
FIG. 1 PRIOR ART
FIG. 1 shows a side elevation view of a conventional sewing machine.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3:
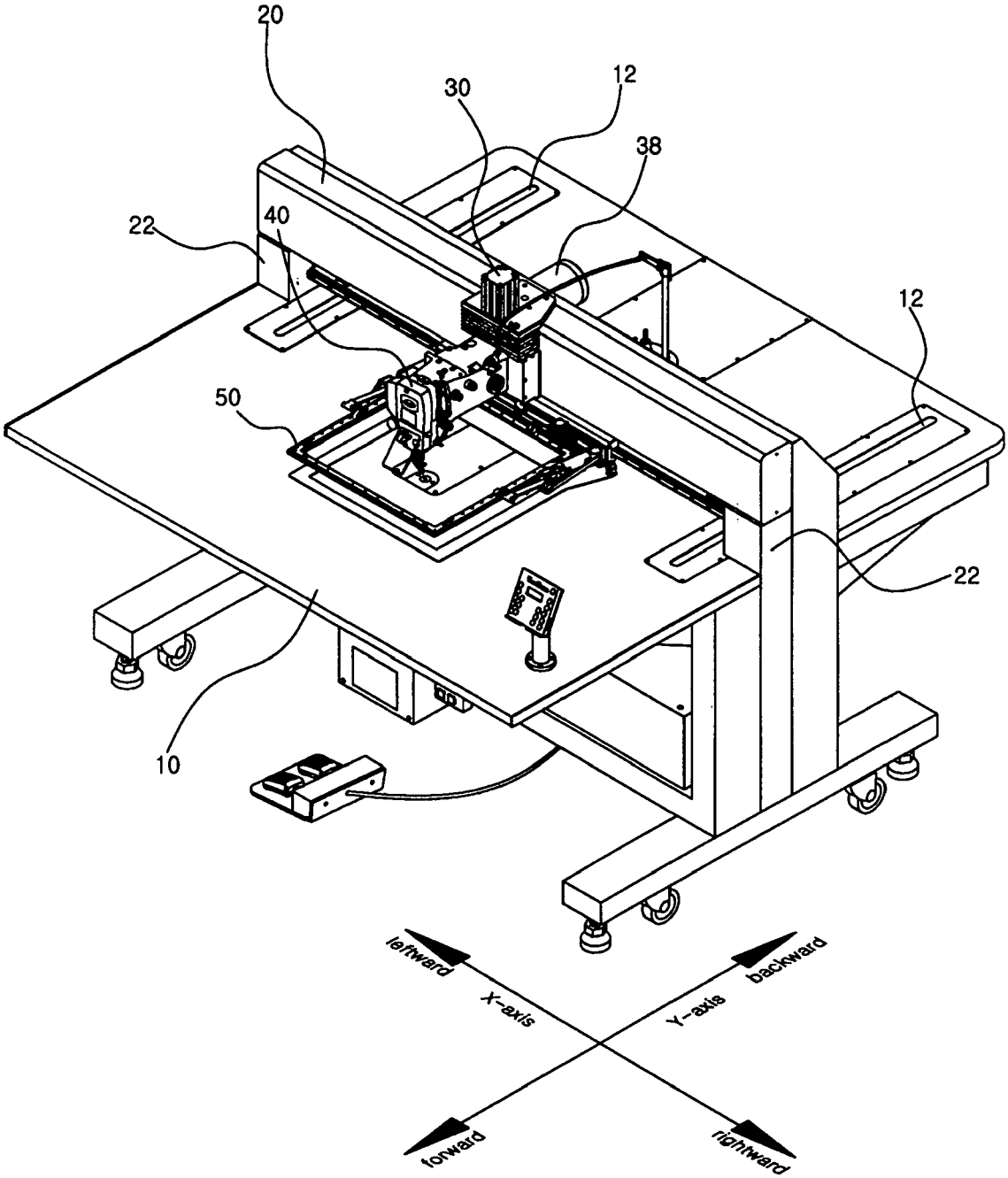
FIG. 3 shows a perspective view of a sewing machine according to the present invention.

FIG. 3 shows a perspective view of a sewing machine according to the present invention. Referring to the drawing, a head portion 40 is positioned above a table 10. The head portion 40 performs a sewing operation on a material retained on a retainer 50.

The table 10 is a square plate on which the material to be sewn is placed. The table 10 is provided with guide holes 12 elongated in the forward and backward director along its opposite sides. The guide holes 12 are adapted to transmit the movement of a Y-axis feeding means 70 (FIG. 4), positioned below the table 10, to a retainer 50, positioned above the table 10.

Supporting posts 22 are formed vertically on the opposite ends of the table 10. A holding frame 20 is supported between the supporting posts 22 in the horizontal direction. The holding frame 20 is preferably made of a rectangular steel tube and has a head portion 40 extending forward from its center portion. An arm lifting device 30 is preferably provided between the head portion 40 and the holding frame 20 to move the head portion 40 upward or downward.

The sewing machine according to the present invention makes it possible to sew a material in an extended area while the head portion 40 is held, because the retainer 50 is adapted to move in the X-axis and Y-axis direction. For this, the holding frame 20 is positioned horizontally for openness in the forward and backward direction, opposite ends of which being supported by the supporting post 22, so that the head portion 40 is held in a bridge-like fashion.

Figure 4:
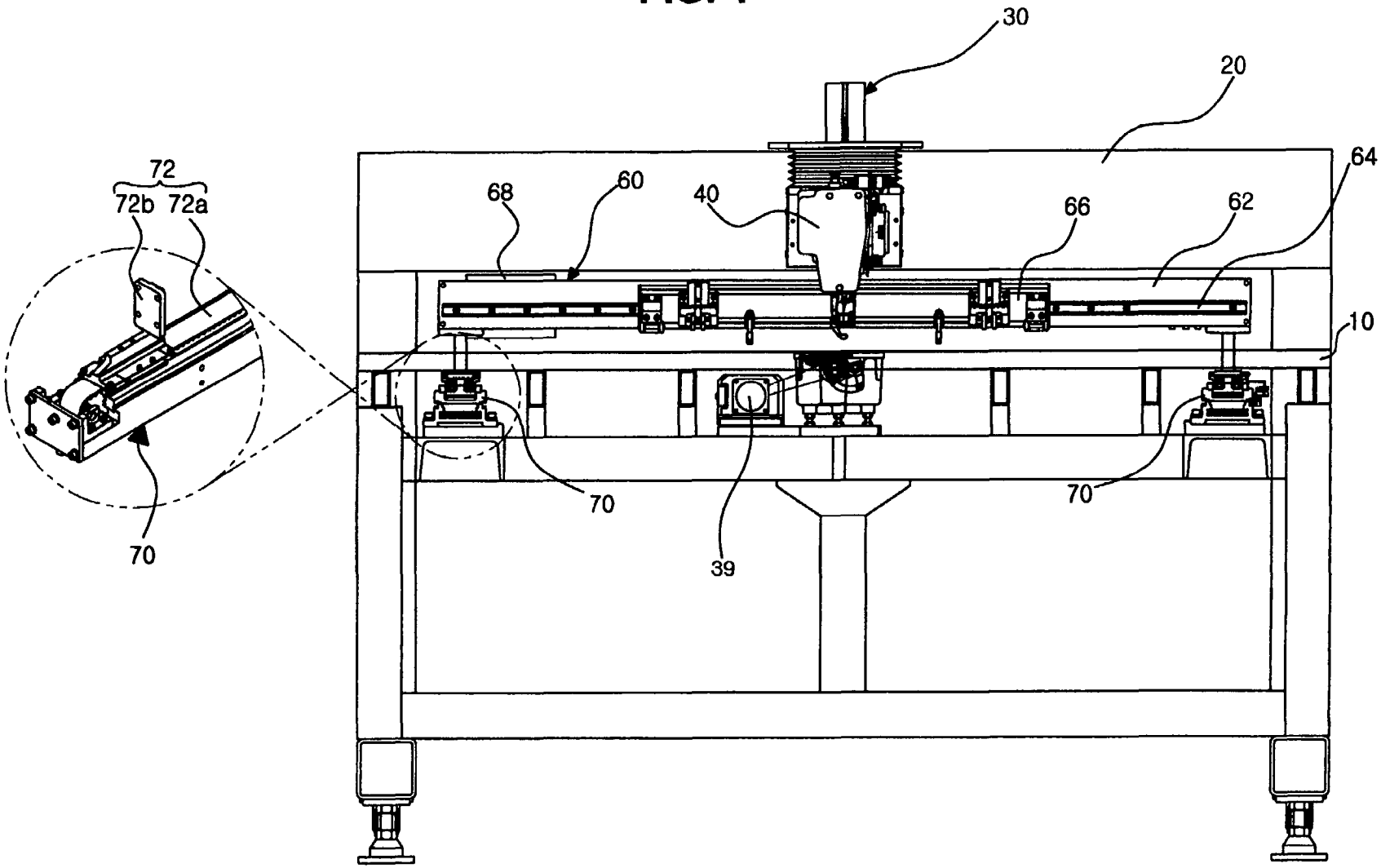
FIG. 4 shows a front view of a sewing machine according to the present invention.
Figure 5:
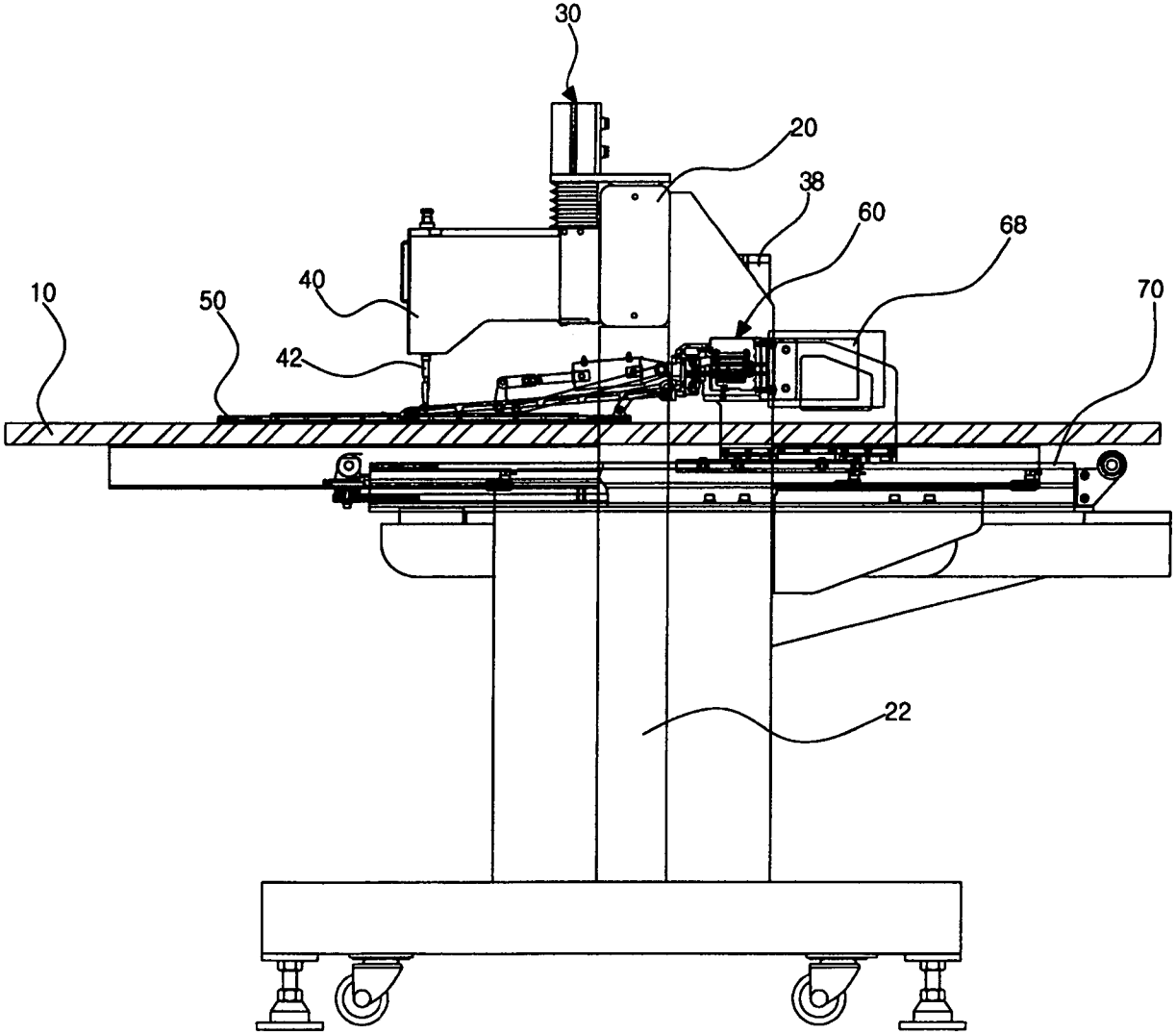
FIG. 5 shows a side elevation view of a sewing machine according to the present invention.

FIGS. 3 to 5 show an arrangement for moving the retainer 50 in the X-axis or Y-axis direction.

An upper shaft driving motor 39 is provided behind the holding frame 20 to drive an upper shaft (not shown) within the head portion 40. The upper shaft driving motor 39 is connected to the upper shaft (not shown), but not to a lower shaft (not shown) for driving a shuttle race body (not shown).

FIG. 4 shows a front view of a sewing machine according to the present invention. Referring to the drawing, an X-axis feeding means 60 is provided above the table 10 and extends in the X-axis direction. Multiple Y-axis feeding means 70 are provided below the table 10 and extend in the Y-axis direction.

The X-axis feeding means 60 comprises an X-axis frame 62 elongated in the X-axis direction, a guide rail 64 installed or formed on the X-axis frame 62, and a holding portion 66 adapted to move leftward or rightward in accordance with the guide rail 64. The retainer 50, on which a material to be sewn is retained, is coupled to the holding portion 66. As the holding portion 66 can move leftward or rightward, it is possible to sew a material in an extended area in the X-axis direction without any movement of the head portion 40.

The Y-axis feeding means 70 enable movement of the retainer 50 in the Y-axis direction, that is, in the forward or backward direction. The Y-axis feeding means 70 extend in the forward and backward direction and have moving portions 72 adapted to move in the forward or backward direction.

The moving portions 72 are preferably made of belts 72*a* adapted to move in the forward or backward direction. Holders 72*b* are coupled on top of the belt 72*a* and protrude upward. The holders 72*b* are displaced forward or backward in accordance with the movement of the belts 72*a*.

Each of the Y-axis feeding means 70, positioned on opposite sides of the table 10, is provided with its own holder 72*b* in parallel orientation. The guide holes 12 of the table 10 expose the holders 72*b* upward. The X-axis frame 62 is connected to the holders 72*b*. When the X-axis feeding means 60 is not coupled, direct connection could be possible using additional extensions from the retainer 50 in the leftward and rightward direction.

As the holders 72*b* move forward or backward in accordance with the movement of the moving portions 72—i.e. the belts 72*a*—the retainer 60, which is connected to the X-axis frame 62, is displace forward or backward accordingly. This makes it possible to sew a material in an extended area in the Y-axis direction without any movement of the head portion 40.

A lower shaft driving motor 39 is positioned below the table 10 to transmit power to a lower shaft (not shown), which is adapted to drive a shuttle race body (not shown). According to the inventive sewing machine, the upper and lower shafts should each be driven separately because, unlike in the prior art, the head portion 40 is held in a bridge-like fashion.

Figure 2:
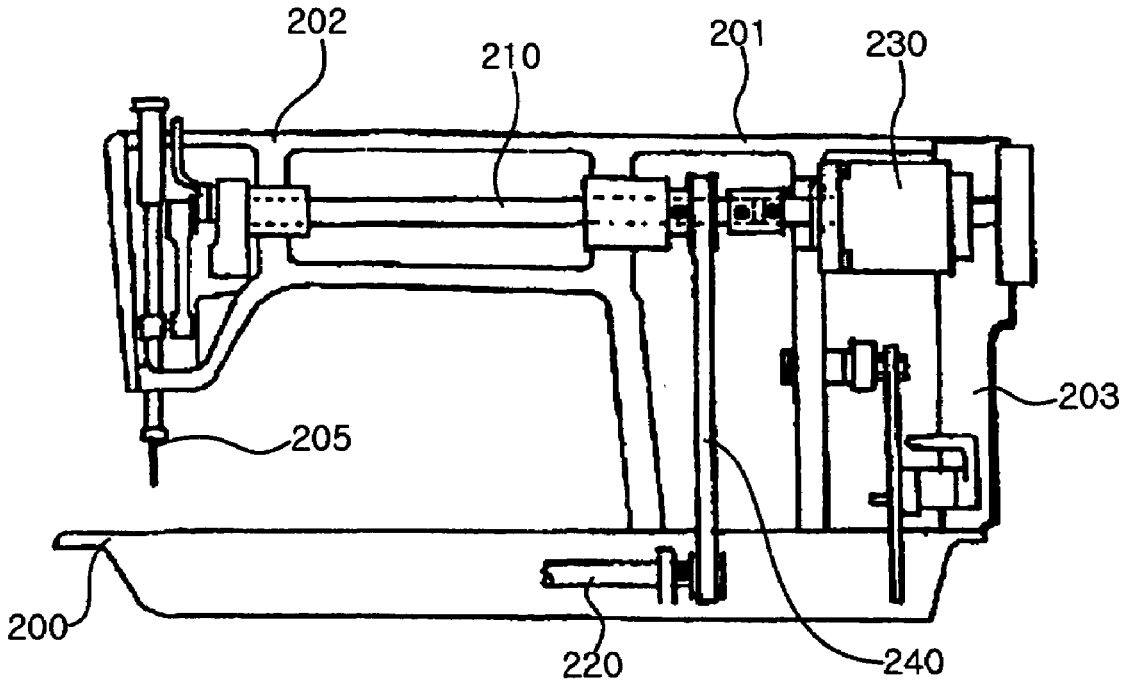
FIG. 2 PRIOR ART
FIG. 2 shows a side sectional view of a conventional sewing machine.

More specifically, a prior sewing machine has a body 203 (FIGS. 1 and 2) positioned in its center portion and a single driving motor 230 for driving the upper and lower shafts 210 and 220 simultaneously. However, the inventive sewing machine has an additional lower shaft driving motor 89 for separate driving of the shafts. A control unit (not shown) controls the driving operation of the upper and lower shafts 38 and 39.

FIG. 5 shows a side elevation view of a sewing machine according to the present invention. Referring to the drawing, each of the X-axis feeding means 60 has an X-axis feeding motor 68 and the Y-axis feeding means 70 extend in the forward and backward direction along the side.

The X-axis feeding means 60 is positioned above the table 10 and is connected to the retainer 50. The Y-axis feeding means 70 is positioned below the table 10 and is connected to the X-axis feeding means 60 through the guide hole 12. Reference numeral 42 denotes a needle.

Figure 6:
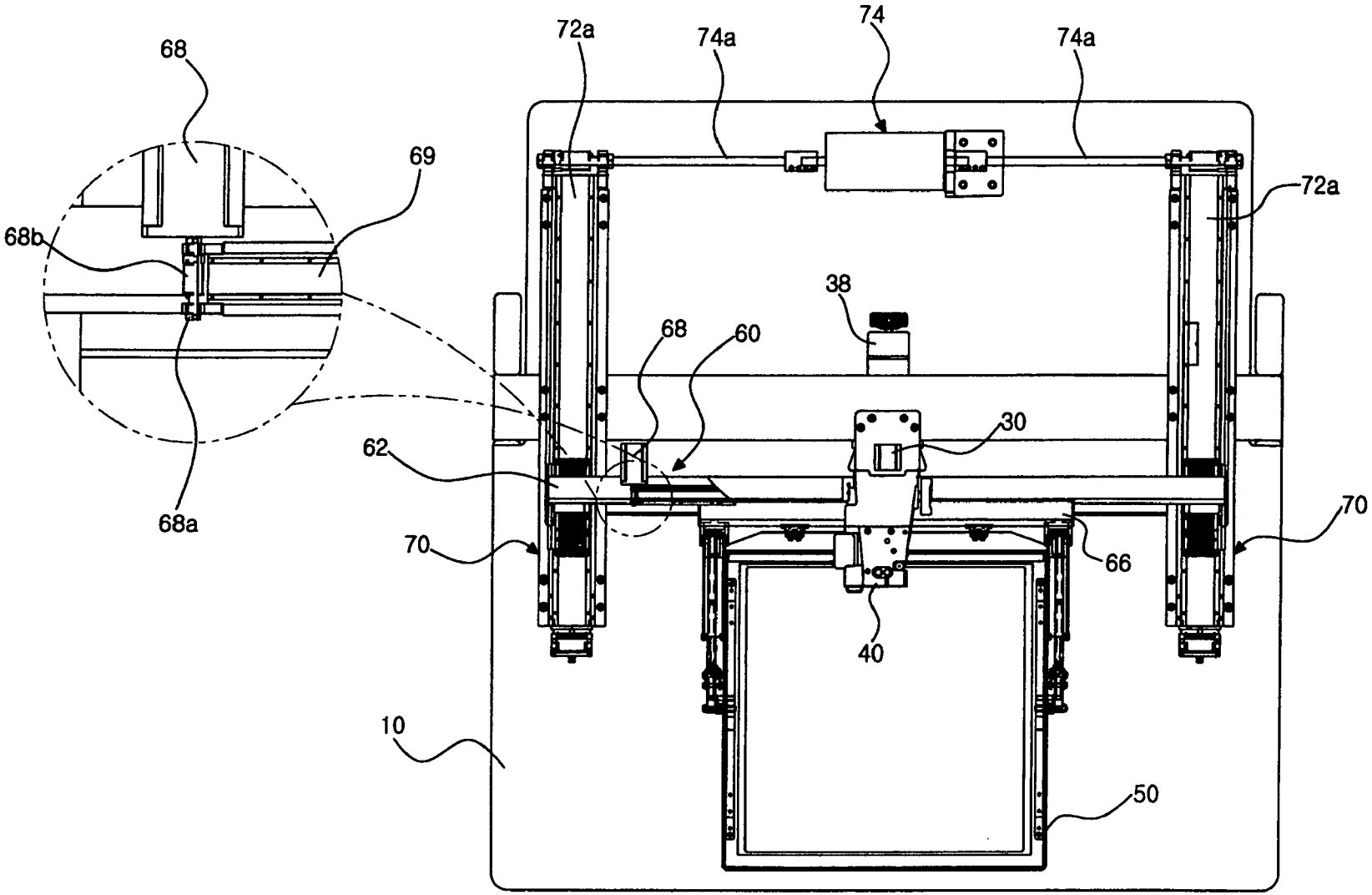
FIG. 6 shows a top view illustrating an X-axis feeding means and Y-axis feeding means according to the present invention.

FIG. 6 shows a top view illustrating an X-axis feeding means and Y-axis feeding means according to the present invention. Referring to the drawing, the X-axis feeding means 60 has an X-axis driving motor 68 provided on a side thereof for driving movement in the leftward or rightward direction The Y-axis feeding means 70 have a Y-axis driving motor 74 for driving movement in the forward or backward direction.

The X-axis driving motor 68 rotates a driving pulley 68*b* coupled to a driving shaft 68*a* which faces forward. This rotation moves a belt 69 leftward or rightward, which is wound around the driving pulley 68*b*. As the belt 69 is moved, a holding portion 66 connected thereto is moved accordingly. As a result, the retainer 50, which is coupled to the holding portion 66, is displaced A following pulley (not shown), which is provided on an end opposite from the end on which the driving pulley 68*b* is provided, winds the belt 69.

The Y-axis driving motor 74 is connected, via driving shafts 74*a*, to the rear portions of the Y-axis feeding means 70, which extend in the forward and backward direction along opposite sides of the table. As the Y-axis driving motor 74 is rotated, the belts 72*a* which are wound around driving pulleys (not shown) are moved forward or backward accordingly.

Holders 72*b* are coupled on top of the belts 72*a* and protrude upward. The holders 72*b* move the X-axis feeding means 60 horizontally forward or backward in accordance with the movement of the belts 72*a*. The belts 72*a* are wound around driving pulleys (not shown) at their rear portions, as well as around following pulleys (not shown) at their front portions.

Figure 7:
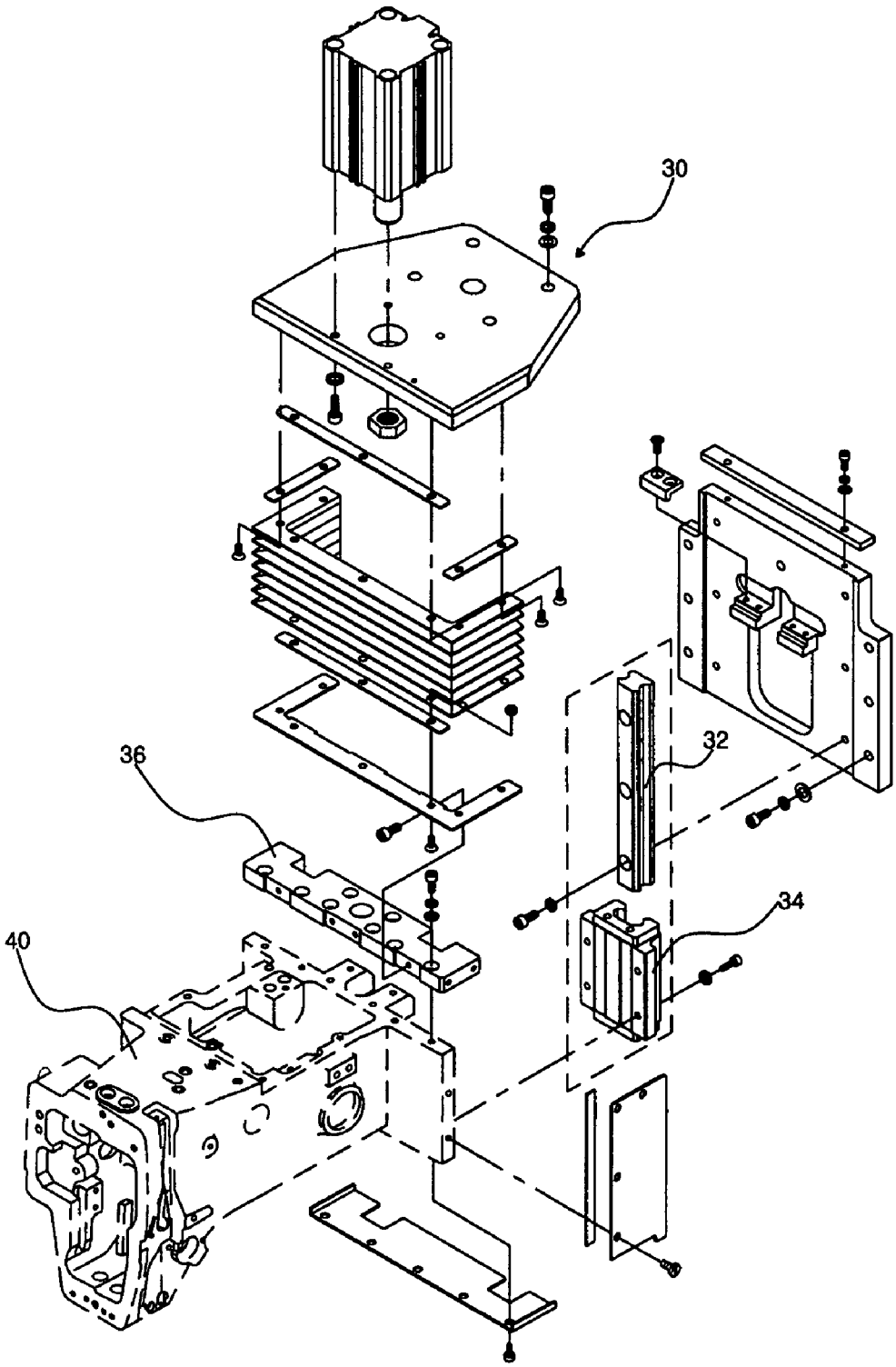
FIG. 7 shows an exploded perspective view of an arm lifting device according to the present invention.

FIG. 7 shows an exploded perspective view of an arm lifting device according to the present invention. Referring to the drawing, a guide plate 32, which is fixedly coupled to the holding frame 20, engages a feeder 34, which is fixedly coupled to the head portion 40, within the arm lifting device 30.

The guide plate 32 is in the shape of a bar elongated in the upward and downward direction and is hollow in its center portion, as in the case of a rail used in the railway. The feeder 34 has rear ends defining a narrowed space between them so that the guide plate 32 can be fitted from above or below into the space. The hollow portion of the guide plate 32 is fitted with the rear ends of the feeder 34. As a result, the feeder 34 can slide upward or downward relative to the guide plate 32, but cannot move laterally, i.e., in the forward or backward directions.

Movement of the arm lifting device 30 in the upward or downward direction can be realized, for example, by means of a pneumatic or hydraulic cylinder or via a mechanical structure, such as the rotation of a screw structure, but the means for movement is not limited thereby.

More specifically, the arm lifting device 30 is supported by the holding frame 20 and the head portion 40 is connected to the arm lifting device 30. A control box (not shown) controls the upward and downward movement through a structure using a pneumatic or hydraulic cylinder or a mechanical structure using a screw.

Figure 8A:
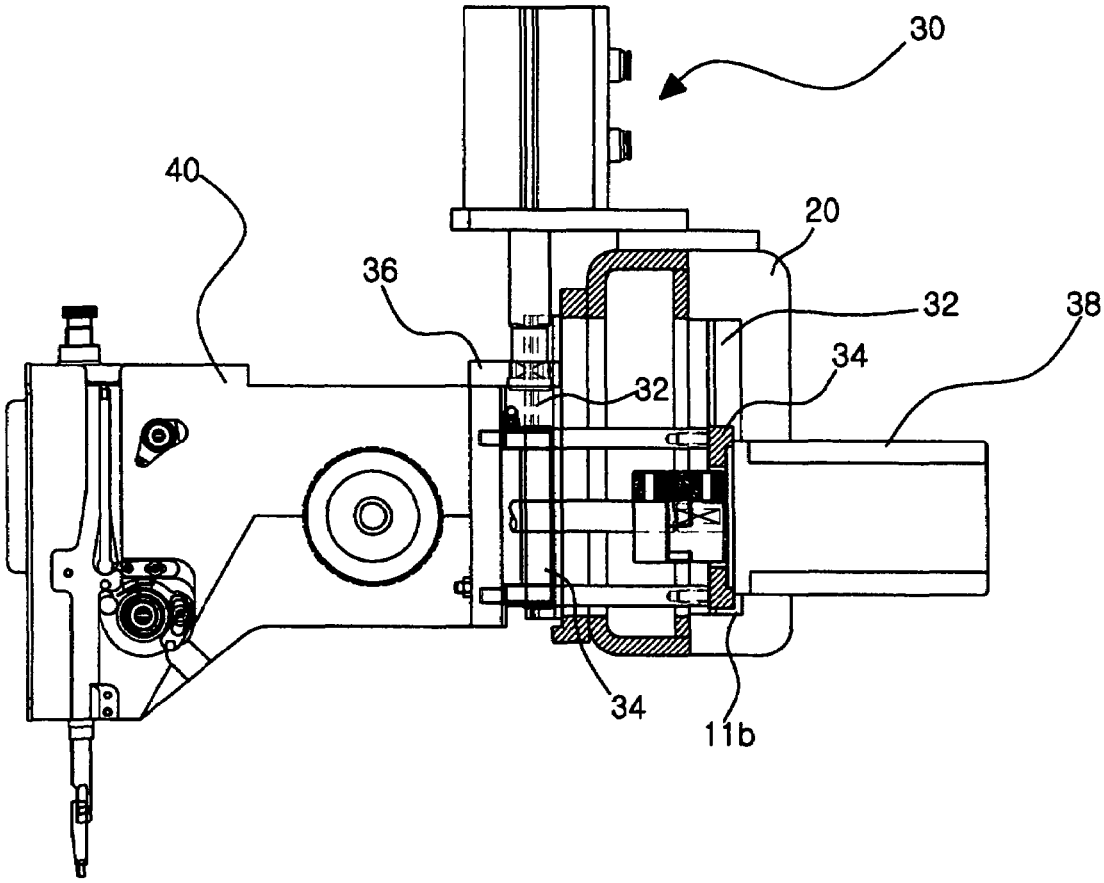
FIG. 8*a* shows a side sectional view illustrating a head portion lowered by an arm lifting device according to the present invention.
Figure 8B:
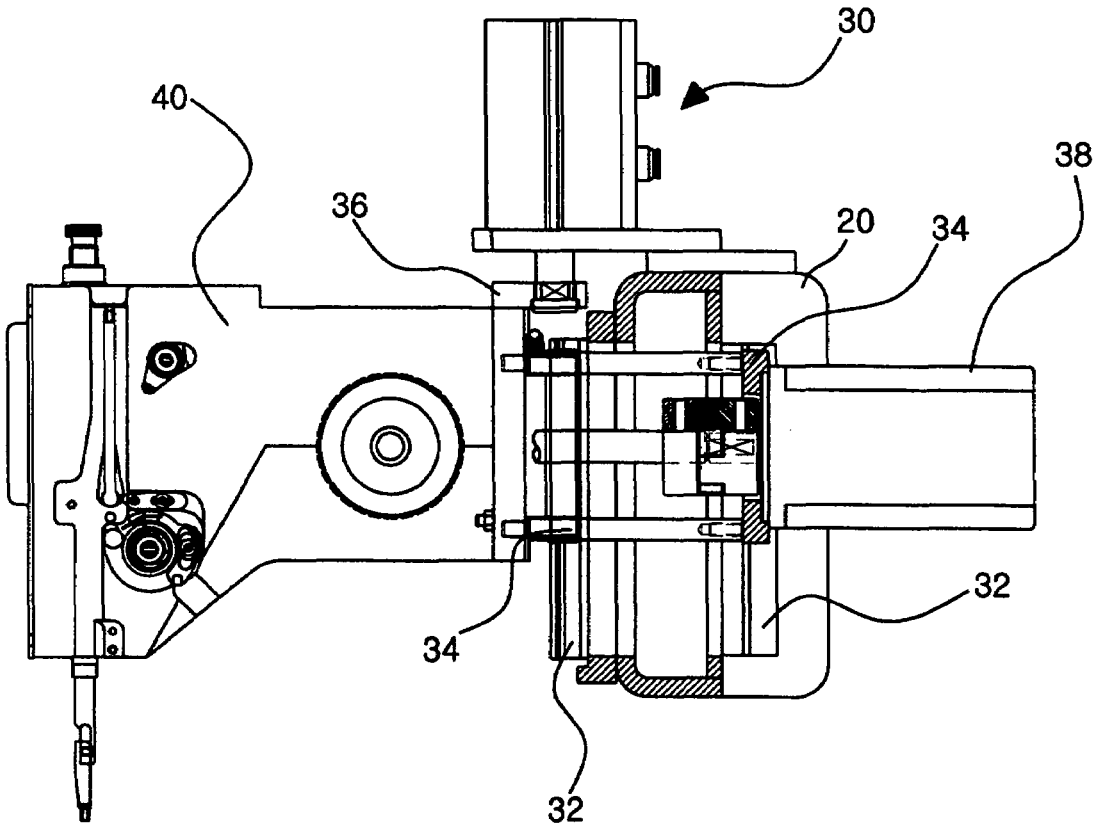
FIG. 8*b* shows a side sectional view illustrating a head portion lifted by an arm lifting device according to the present invention.

FIGS. 8*a* and 8*b* show side sectional views illustrating a head portion lowered and lifted respectively by an arm lifting device according to the present invention. Referring to the drawing, the feeder 34, which is integrated and moved together with the head portion 40, is displaced upward or downward in accordance with the guide plate 32, which is integrated to the holding frame 20.

When the arm lifting device 30 applies pneumatic pressure through an upper pneumatic pressure opening (not shown), the lifting plate 36 within the arm lifting device 30 is pushed down from above and lowered accordingly. This makes the feeder 34 descend along the guide plate 32 and, as a result, the head portion 40 is moved downward.

When the head portion 40 is to be moved upward, on the other hand, pneumatic pressure is discharged through a lower pneumatic pressure opening (not shown). The lifting plate 36 within the arm lifting device 30 is then lifted. This makes the feeder 34 ascend along the guide plate 32 and, as a result, the head portion 40 is moved upward.

If the head portion 40 has finished its operation, the arm lifting device 30 lifts the head portion 40 to facilitate removal of the sewn material. If another material is placed in position to be sewn, the head portion 40 is lowered for sewing so that the needle 42 can approach the material.

This behavior makes it possible to use the retainer 50 in the sewing machine more efficiently and to sew thicker materials, although only materials the thicknesses of which are below a determined value can be sewn with prior sewing machines.

The present invention eliminates any coupling portion between an arm and a bed, as used in prior sewing machines. Instead, the inventive sewing machine has a holding frame supported by support posts, a head portion mounted on the holding frame, and a means for driving its upper shaft separately. Due to an arch-shaped arrangement positioned on its center portion without any structure for connecting upper and lower portions, sewing area is substantially increased in the Y-axis direction. Accordingly, it is possible to sew materials with unlimited length, such as a long cloth, without any interruption.

In addition, the retainer can be lifted when sewing is started or finished and the head portion can be moved up and down. This makes it possible to easily place and remove the material to be sewn and to process materials with various thicknesses, although only thin materials can be sewn with conventional sewing machines.

The inventive sewing machine separately drives its upper and lower shafts using separate driving motors. This avoids any overloading to single motor adapted to drive upper and lower shafts simultaneously via, for example, a timing belt.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sewing machine comprising:

a head portion having a sewing needle driven to vertically reciprocate;

a lower shaft having a shuttle connected thereto which is driven to rotate synchronized with the vertical movement of the sewing needle cooperating to form stitches;

a table positioned above the lower shaft;

a retainer positioned above the table to retain a material for forming stitches thereon;

a holding frame placed parallel to the table, the head portion being mounted at a position on the holding frame;

an arm lifting device coupled to the holding frame together with the head portion for moving the head portion upward or downward; and supporting posts adapted to support opposite ends of the holding frame for positioning the holding frame above the table.

2. The sewing machine as claimed in claim 1, further comprising:

an X-axis feeding means installed above the table to move the retainer in a leftward and rightward direction along an X-axis; and a Y axis-feeding means installed below the table to move the X-axis feeding means in a forward and backward directions along the Y-axis direction.

3. The sewing machine as claimed in claim 2, wherein the X-axis feeding means comprises:

an X-axis frame elongated in the leftward and rightward direction;

a guide rail installed or formed in the X-axis frame;

a holding portion coupled with the guide rail to move in the leftward and rightward direction while holding the retainer; and an X-axis driving motor for moving the holding portion.

4. The sewing machine as claimed in claim 2, wherein the Y-axis feeding means comprises:

a moving portion for moving the X-axis feeding means in the forward or backward direction; and a Y-axis driving motor for moving the moving portion.

5. The sewing machine as claimed in claim 4, wherein the moving portion comprises a belt moved by the Y-axis driving motor.

6. The sewing machine as claimed in claim 1, wherein the arm lifting device comprises:

a guide plate held on the holding frame; and a feeder held on the head portion, the feeder being adapted to move upward and downward in accordance with the guide plate.

7. The sewing machine as claimed in claim 6, wherein the arm lifting device is moved upward and downward using hydraulic pressure.

8. The sewing machine as claimed in claim 6, wherein the arm lifting device is moved upwards and downward using pneumatic pressure.

9. The sewing machine as claimed in claim 1, wherein the arm lifting device is moved upward and downward using hydraulic pressure.

10. The sewing machine as claimed in claim 9, further comprising:

an X-axis feeding means installed above the table to move the retainer in a leftward and rightward direction along an X-axis; and a Y axis-feeding means installed below the table to move the X-axis feeding means in a forward and backward directions along the Y-axis direction.

11. The sewing machine as claimed in claim 1, further comprising:

an upper axis driving motor connected to an upper shaft for driving the sewing needle of the head portion to vertically reciprocate; and a lower axis driving motor connected to the lower shaft for driving the shuttle to rotate.

12. The sewing machine as claimed in claim 1, wherein the arm lifting device is moved upwards and downward using pneumatic pressure.

13. The sewing machine as claimed in claim 12, further comprising:

an X-axis feeding means installed above the table to move the retainer in a leftward and rightward direction along an X-axis; and a Y axis-feeding means installed below the table to move the X-axis feeding means in a forward and backward directions along the Y-axis direction.

* * * * *